US009938870B2

(12) United States Patent
Reichelt et al.

(10) Patent No.: US 9,938,870 B2
(45) Date of Patent: Apr. 10, 2018

(54) EXHAUST GAS MUFFLER

(71) Applicant: TENNECO GMBH, Edenkoben (DE)

(72) Inventors: Frank Reichelt, Bellheim (DE); Gabriel Ostromecki, Wroclaw (PL)

(73) Assignee: TENNECO GMBH, Edenkoben (DE)

( * ) Notice: Subject to any disclaimer, the term of this patent is extended or adjusted under 35 U.S.C. 154(b) by 0 days.

(21) Appl. No.: 15/123,385

(22) PCT Filed: Mar. 2, 2015

(86) PCT No.: PCT/EP2015/054312
§ 371 (c)(1),
(2) Date: Sep. 2, 2016

(87) PCT Pub. No.: WO2015/132205
PCT Pub. Date: Sep. 11, 2015

(65) Prior Publication Data

US 2017/0074133 A1 Mar. 16, 2017

(30) Foreign Application Priority Data

Mar. 7, 2014 (DE) ..... 10 2014 103 054

(51) Int. Cl.
*F01N 13/02* (2010.01)
*F01N 1/02* (2006.01)
(Continued)

(52) U.S. Cl.
CPC ..... *F01N 1/023* (2013.01); *F01N 13/02* (2013.01); *F01N 13/04* (2013.01); *G10K 11/161* (2013.01);
(Continued)

(58) Field of Classification Search
CPC .. F01N 13/02; F01N 2470/22; F01N 2470/24; F01N 2490/155
(Continued)

(56) References Cited

U.S. PATENT DOCUMENTS 2,290,818 A * 7/1942 Tyskewicz ..... F01N 1/06 181/265
2,297,046 A * 9/1942 Bourne ..... F01N 1/006 110/184
(Continued)

FOREIGN PATENT DOCUMENTS

DE 102 54 631 A1 6/2004
DE 10 2005 054 002 A1 5/2007
(Continued)

*Primary Examiner* — Jeremy Luks
(74) *Attorney, Agent, or Firm* — Hudak, Shunk & Farine Co. LPA

(57) ABSTRACT

An exhaust gas muffler of an internal combustion engine, including a muffler housing having an exhaust gas inlet and an exhaust gas outlet and including a first Helmholtz resonator made of a first housing portion that delimits a first Helmholtz volume and includes a first coupling pipe. At least one second Helmholtz resonator is provided made of a second housing portion that delimits a second Helmholtz volume and includes a second coupling pipe via which the second Helmholtz volume can be coupled to an exhaust gas flow A of the exhaust gas inlet. The second coupling pipe is arranged at least partly within the first coupling pipe, and both coupling pipes delimit an annular gap R via which the first Helmholtz volume can be coupled to the exhaust gas flow A.

20 Claims, 2 Drawing Sheets

(51) Int. Cl.
*F01N 13/04* (2010.01)
*G10K 11/16* (2006.01)

(52) U.S. Cl.
CPC ..... *F01N 2470/22* (2013.01); *F01N 2470/24* (2013.01); *F01N 2490/08* (2013.01); *F01N 2490/155* (2013.01)

(58) Field of Classification Search
USPC ..... 181/232, 251, 257, 268, 272, 275
See application file for complete search history.

(56) References Cited

U.S. PATENT DOCUMENTS

| | | | | |
|---|---|---|---|---|
| 2,357,792 | A | 9/1944 | Powers | |
| 2,834,427 | A | 5/1958 | Powers et al. | |
| 3,434,565 | A * | 3/1969 | Fischer | F01N 1/006 181/250 |
| 3,613,830 | A * | 10/1971 | Hubbell, III | B21D 53/88 138/115 |
| 4,501,341 | A | 2/1985 | Jones | |
| 4,759,423 | A * | 7/1988 | Harwood | F01N 1/003 181/250 |
| 4,841,728 | A | 6/1989 | Jean et al. | |
| 5,493,080 | A * | 2/1996 | Moss | F01N 1/003 181/227 |
| 5,708,237 | A | 1/1998 | Maeda et al. | |
| 6,141,958 | A | 11/2000 | Voss | |
| 6,732,510 | B2 | 5/2004 | Ciray | |
| 7,281,605 | B2 | 10/2007 | Huff et al. | |
| 7,337,609 | B2 | 3/2008 | Mahnken et al. | |
| 8,550,210 | B2 | 10/2013 | Kondou | |
| 8,607,923 | B2 | 12/2013 | Takagaki et al. | |
| 9,593,607 | B2 | 3/2017 | Das et al. | |
| 9,638,077 | B2 | 5/2017 | Hörr | |
| 2005/0252716 | A1* | 11/2005 | Moenssen | F02M 35/1216 181/277 |
| 2007/0107982 | A1 | 5/2007 | Sullivan | |
| 2008/0066999 | A1* | 3/2008 | Kostun | F02M 35/1222 181/250 |
| 2014/0034416 | A1* | 2/2014 | Liu | F02C 7/045 181/290 |

FOREIGN PATENT DOCUMENTS

| | | | |
|---|---|---|---|
| DE | 102008062014 | A1 | 6/2010 |
| EP | 0 839 993 | A2 | 5/1998 |
| FR | 48 791 | | 6/1938 |
| GB | 391180 | A | 7/1931 |
| JP | 60-30463 | S | 2/1985 |
| KR | 200457936 | Y1 | 12/2011 |
| KR | 20140111154 | A | 9/2014 |
| WO | 82 00854 | A1 | 3/1982 |

* cited by examiner

EXHAUST GAS MUFFLER

FIELD OF THE INVENTION

The invention relates to an exhaust gas muffler of an internal combustion engine, comprising a muffler housing having an exhaust gas inlet and an exhaust gas outlet and comprising a first Helmholtz resonator, made of a first housing portion that delimits a first Helmholtz volume and that comprises a first coupling pipe, wherein at least one second Helmholtz resonator is provided made of a second housing portion that delimits a second Helmholtz volume and comprises a second coupling pipe, via which the second Helmholtz volume can be coupled to an exhaust gas flow A of the exhaust gas inlet.

BACKGROUND OF THE INVENTION

An exhaust gas muffler with a Helmholtz resonator is already known from DE 10254631 B4. The Helmholtz resonator has a Helmholtz pipe, via which it is connected to an exhaust gas supply line. In addition, an exhaust gas pipe is provided that is arranged coaxially to the Helmholtz pipe and with this delimits an annular gap R, via which the Helmholtz resonator is supplied. The exhaust gas pipe passes through the Helmholtz resonator to a reflection chamber, connecting in the direction of flow to the Helmholtz resonator, to which the exhaust pipe connects.

According to DE 10 2005 054 002 A1 the exhaust gas flow is directly coupled via the branched exhaust gas inlet pipe to a plurality of Helmholtz resonators.

According to U.S. Pat. No. 4,501,341 A the exhaust gas flow is directly coupled via a branching of the exhaust gas inlet pipe to a Helmholtz resonator.

From WO 82 00 854 A1 it is known to couple an exhaust gas flow of the exhaust gas inlet to a Helmholtz resonator via a separate coupling pipe arranged coaxially to the exhaust gas inlet.

From EP 0 839 993 A2 it is similarly known to couple an exhaust gas flow of the exhaust gas inlet via a separate first coupling pipe arranged coaxially to the exhaust gas inlet, to a Helmholtz resonator. A second coupling pipe is also provided, positioned parallel to the first coupling pipe, via which a second Helmholtz resonator is coupled.

SUMMARY OF THE INVENTION

The object of the invention is to improve and arrange an exhaust gas muffler with Helmholtz resonator so that a better frequency response is guaranteed.

The object is achieved according to the invention in that the second coupling pipe is arranged at least partly within the first coupling pipe, and both coupling pipes delimit an annular gap R via which the first Helmholtz volume can be coupled to the exhaust gas flow A.

This allows at least two Helmholtz resonators, each working in different frequency ranges, to be arranged one behind the other and despite this to be directly blown against. Through the overlapping frequency responses of both Helmholtz resonators hereby achieved, a substantially greater frequency range is covered so that very extensive overall damping of the engine noise is possible.

The respective coupling pipe can also have a multi-piece construction. A coupling pipe with a varying diameter is also possible.

To this end it can also be advantageous if the second coupling pipe is passed through the first housing portion and both housing portions or both Helmholtz volumes are arranged one after another in relation to a direction RK of the second coupling pipe. This allows a twin Helmholtz resonator to be created in a small space.

It can also be advantageous if the annular gap R has an inlet opening E1 having a normal N1, wherein the normal N1, with a direction of flow S of the exhaust gas inlet nozzle, includes an angle a, with $90° < a \leq 180°$ or $100° \leq a \leq 180°$. The inlet opening E1 is formed by the two pipe ends or the respective pipe edges, delimiting the annular gap R.

It can also be advantageous if the second coupling pipe has an inlet opening E2 with a normal N2, wherein the normal N2, with a direction of flow S of the exhaust gas inlet nozzle, includes an angle b, with $0° \leq b < 90°$.

While the exhaust gas coming from direction of flow S of the exhaust gas inlet nozzle runs parallel to the inlet opening E1, E2, and thus at right-angles to the normal N1, N2, and so just overflows the inlet opening E1, E2, this is referred to as "overflowing" of the Helmholtz resonator. Otherwise, if the direction of flow S in relation to the inlet opening E1, E2 has a directional component at right-angles thereto, and consequently parallel to the normal N1, N2, as claimed, then "blowing against" the Helmholtz resonator is referred to. Independently of this, upstream the direction of flow S can be formed as desired according to the further form of the exhaust gas inlet nozzle.

In doing so it can advantageously be provided that in at least one housing portion at least one perforated resonator wall is provided within the Helmholtz volume. The respective Helmholtz volume can also be divided by a perforated resonator wall, wherein the various parts of the Helmholtz volume functionally appertain to the one Helmholtz resonator. As explained below, a distinction should be made between these and housing walls with a leakage opening provided for the separation of various housing portions.

It can be of particular importance for the invention if the first Helmholtz volume is delimited by housing walls within the muffler housing, and in at least one housing wall a leakage opening is provided and/or if the second Helmholtz volume is partly delimited by the housing wall and the leakage opening is provided in the housing wall. Via the leakage opening a coupling takes place between the respective Helmholtz volume and a volume of another housing portion within the muffler housing. The leakage opening can take the form of a recess or the leakage pipe, so that a coupling with directly or indirectly adjoining portions is possible.

A Helmholtz volume can therefore in addition to the coupling pipe have a further opening in the form of a leakage and does not have to be fully compartmentalised from adjoining chambers. The size of the leakage opening is however limited, preferably to a value of less than 200 $mm^2$. Consequently, the leakage is restricted to a fraction of the exhaust gas flow passing through the exhaust gas muffler of a maximum 2% to 5%. Such a design is very similar to a conventional Helmholtz resonator, for it guarantees an acoustic performance similar to that of a conventional Helmholtz resonator.

In connection with the improvement and arrangement according to the invention it can be advantageous if the muffler housing has at least one further housing portion or one further housing chamber with a housing wall, wherein the leakage opening couples both Helmholtz volumes with one another and/or at least one Helmholtz volume with the housing portion. Consequently, a substantially acoustic coupling of the Helmholtz volume with a further volume is guaranteed. Thus, this is accompanied by a particular acoustic performance.

It can also be advantageous if the leakage opening of a housing wall has an overall cross-section L with $0 \Leftarrow L \Leftarrow 500$ $mm^2$ or $0 \Leftarrow L \Leftarrow 200$ $mm^2$ or $0 \Leftarrow L \Leftarrow 100$ $mm^2$ or $0 \Leftarrow L \Leftarrow 50$ $mm^2$. The leakage opening with an overall cross-section L is sufficiently small to guarantee the effect as a Helmholtz volume or Helmholtz resonator.

BRIEF DESCRIPTION OF THE DRAWINGS

Further advantages and details of the invention are described in the claims and in the description and illustrated in the Figures. These show as follows:

DETAILED DESCRIPTION OF THE INVENTION

Figure 1:
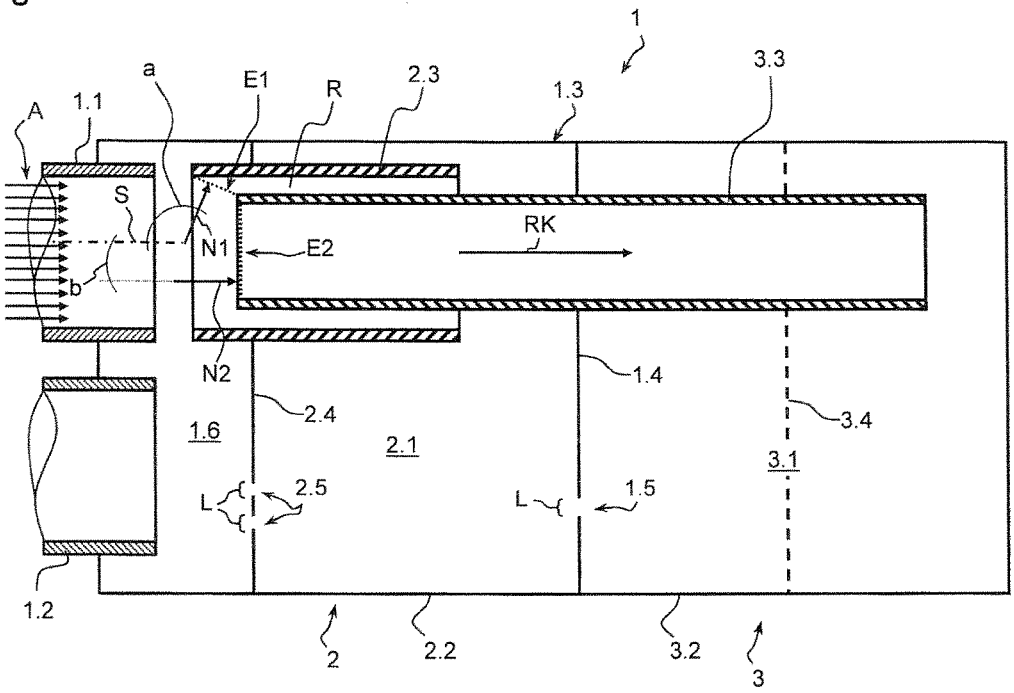
FIG. 1 a schematic diagram of an exhaust gas muffler with two Helmholtz resonators.

An exhaust gas muffler 1 according to FIG. 1 has a muffler housing 1.3, which serves to accommodate an exhaust gas inlet nozzle 1.1 and an exhaust gas outlet nozzle 1.2. The muffler housing 1.3 also has two further housing walls 1.4, 2.4, so that in total three housing portions 3.2, 2.2, 1.6 are formed. Whereas the inlet nozzle 1.1 and the outlet nozzle 1.2 for connecting the exhaust gas system 4 shown in FIG. 2 discharge within the third housing portion 1.6, which is designed as a reflection chamber, the first and the second housing portions 3.2, 2.2 in each case delimit a Helmholtz volume 2.1, 3.1 as part of a first and second Helmholtz resonator 2, 3. The first Helmholtz volume 2.1 is fed via a coupling pipe 2.3 which, in the same manner as the inlet nozzle 1.1, discharges within the third housing portion 1.6, so that the exhaust gas flow A entering through the inlet nozzle 1.1 encounters the first coupling pipe 2.3 in the axial direction. Within the first coupling pipe 2.3 a second coupling pipe 3.3 is arranged, which at its end discharges into the second Helmholtz volume 3.1. The second coupling pipe 3.3 has an inlet opening E2, which is similarly arranged directly in front of the exhaust gas inlet nozzle 1.1, so that the exhaust gas flow A when leaving the exhaust gas inlet nozzle 1.1 encounters the inlet opening E2. Both coupling pipes 2.3, 3.3 are axially displaced so that the second coupling pipe 3.3 in relation to a direction RK is positioned inwardly offset in the first coupling pipe 2.3. Between the first coupling pipe 2.3 and the second coupling pipe 3.3 an annular gap R is thus formed, via which the first Helmholtz volume 2.1 is coupled to the exhaust gas inlet nozzle 1.1. The annular gap R similarly has an inlet opening E1, which is delimited by the respective frontal pipe edge of the first or second coupling pipe 2.3, 3.3, wherein in the case of the first coupling pipe 2.3 the inner front edge, and in the case of the second coupling pipe 3.3 the outer front edge, is involved.

The inlet opening E1 is associated with a normal N1, which with a direction of flow S of the exhaust gas flow A includes an angle a. In this way direct blowing against the first Helmholtz volume 2.1 via the first coupling pipe 2.3 is guaranteed, should the angle a be greater than 90°. An angle a of 90° would mean that the exhaust gas flow A or its direction of flow S was running at right-angles to the inlet opening E1, and the inlet opening was only being overflowed. At 180° full blowing occurs. Essentially, an angle a of less than 90° is also conceivable. In this case the second coupling pipe 3.3 overhangs the end face of the first coupling pipe 2.3 in the direction of the exhaust gas inlet nozzle 1.1, so that the inlet opening E1, in the same manner as the inlet opening E2, has a normal N1, N2, running parallel to the direction of flow S.

As already stated the normal N2 of the inlet opening E2 with the direction of flow S includes an angle b of 0°, e.g. the direction of flow S runs parallel to the normal N2. Depending on the chamfer of the second coupling pipe 3.3 the position of the inlet opening E2 may vary, so that the normal N2 includes an angle b>0 to the direction of flow S; the angle b should not reach 90°, however, so that direct blowing via the second coupling pipe 3.3 is possible.

With the abovementioned angles the values given for a and b respectively, can be assumed. Similarly, 0° can be equated to 180°. The abovementioned nomenclature results simply on the basis of the assumed directions of flow S of the exhaust gas on the one hand and the normal N1, N2 on the other.

Inside the second Helmholtz volume 3.1 a resonator wall 3.4 is provided, in the form of a perforated dividing wall. It has a certain dividing effect on the Helmholtz volume 3.1, but does not lead to a total separation of the Helmholtz volume 3.1, so that the Helmholtz volume 3.1 together with the coupling pipe 3.3 forms the second Helmholtz resonator 3 as an independent functional unit.

In the housing wall 1.4, which in this embodiment forms the dividing wall between the first Helmholtz volume 2.1 and the second Helmholtz volume 3.1, a leakage opening 1.5 is provided, which guarantees a leakage or overflow between both Helmholtz volumes 2.1, 3.1. Here the leakage opening has a dimension L of approximately 80 $mm^2$. Similarly, in the housing wall 2.4, forming a dividing wall with the third housing portion 1.6, a leakage in the form of a double leakage opening 2.5 of dimension L is provided, via which the first Helmholtz volume 2.1 can communicate with the third housing portion 1.6 or the exhaust gas outlet nozzle 1.2 and/or the exhaust gas inlet nozzle.

The third housing portion 1.6 or the reflection chamber thus formed can also have a multi-piece construction, so that the exhaust gas inlet nozzle 1.1 or the exhaust gas outlet nozzle 1.2 and the respective coupling pipe 2.3, 3.3 discharge in the same or adjoining chamber parts of the third housing portion 1.6. In this case the corresponding volumes would be coupled together via corresponding openings.

Figure 2:
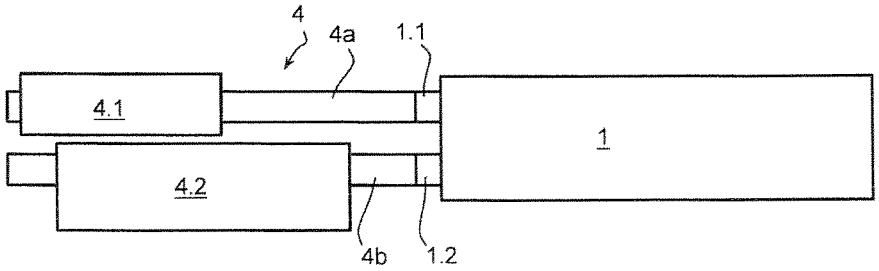
FIG. 2 a schematic diagram of an exhaust gas system.

In the embodiment of FIG. 2 the exhaust gas muffler 1 is coupled to an exhaust gas system 4 of a motor vehicle, wherein in an inlet pipe 4*a* of the exhaust gas system, which is connected with the exhaust gas inlet nozzle 1.1, a catalytic converter 4.1 is provided, while in an outlet pipe 4*b* of the exhaust gas system 4 a rear muffler 4.2 is provided.

Figure 3:
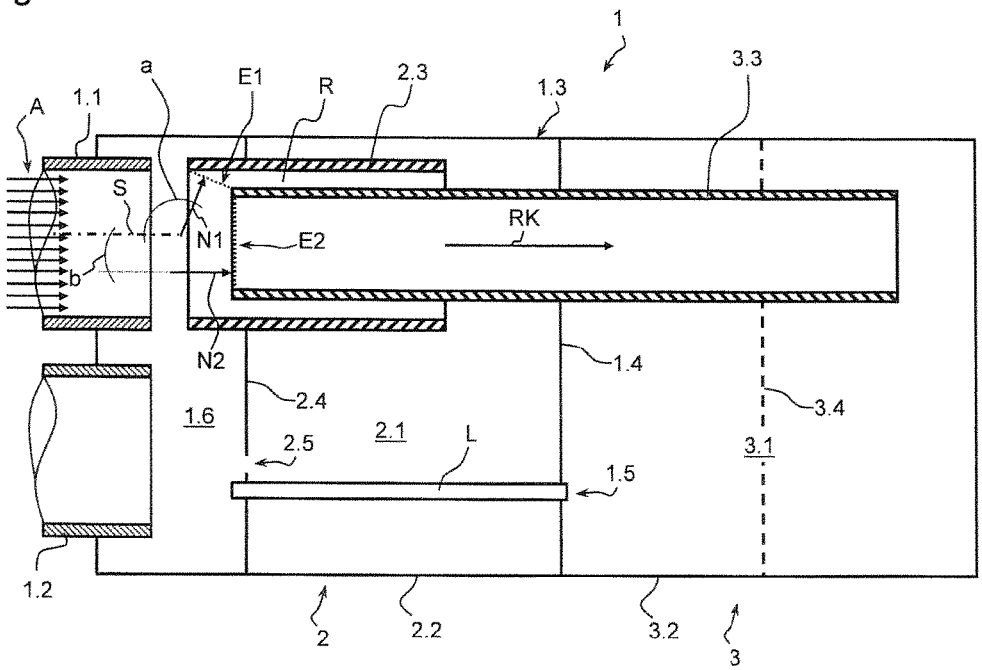
FIG. 3 a schematic diagram according to FIG. 1 with leakage pipe.

According to the exemplary embodiment of FIG. 3, the leakage opening 1.5 of the second Helmholtz volume 3.1 is formed by a pipe and connects the second Helmholtz volume 3.1 directly with the third housing portion 1.6, while the first Helmholtz volume 2.1 is similarly coupled via the leakage opening 2.5 to the housing portion 1.6. Thus both Helmholtz volumes 2.1, 3.1 are not directly coupled together.

Essentially, the leakage opening of the respective Helmholtz volume 2.1, 3.1 can also be fully dispensed with.

LIST OF REFERENCE NUMERALS

1 Exhaust gas muffler

1.1 Exhaust gas inlet, nozzle

1.2 Exhaust gas outlet, nozzle
1.3 Muffler housing
1.4 Housing wall, dividing wall
1.5 Leakage opening, recess, leakage pipe
1.6 Third housing portion, reflection chamber
2 First Helmholtz resonator
2.1 First Helmholtz volume
2.2 First housing portion, housing wall
2.3 First coupling pipe
2.4 Housing wall
2.5 Leakage opening, recess
3 Second Helmholtz resonator
3.1 Second Helmholtz volume
3.2 Second housing portion, housing wall
3.3 Second coupling pipe
3.4 Resonator wall
4 Exhaust gas system
4*a* Inlet pipe
4*b* Outlet pipe
4.1 Catalytic converter
4.2 Rear muffler
A Exhaust gas flow
a Angle
b Angle
E1 Inlet opening
E2 Inlet opening
N1 Normal
N2 Normal
R Annular gap
RK Direction
S Direction of flow
L Overall cross-section, size

What is claimed is:

1. An exhaust gas muffler of an internal combustion engine, comprising: a muffler housing having an exhaust gas inlet and an exhaust gas outlet and comprising a first Helmholtz resonator, made of a first housing portion that delimits a first Helmholtz volume and comprises a first coupling pipe, wherein at least one second Helmholtz resonator is provided made of a second housing portion that delimits a second Helmholtz volume and comprises a second coupling pipe via which the second Helmholtz volume can be coupled to an exhaust gas flow (A) of the exhaust gas inlet, wherein the second coupling pipe is arranged at least partly within the first coupling pipe, and both coupling pipes delimit an annular gap (R) via which the first Helmholtz volume can be coupled to the exhaust gas flow (A), wherein the muffler housing comprises a third housing portion in which the exhaust gas inlet and the first coupling pipe discharge, wherein the first coupling pipe has a first inlet opening that fully covers an outlet opening of the exhaust gas inlet in an axial direction given by the first coupling pipe.

2. The exhaust gas muffler according to claim 1, wherein the second coupling pipe is passed through the first housing portion and both housing portions or both Helmholtz volumes are arranged one after another in relation to a direction (RK) of the second coupling pipe.

3. The exhaust gas muffler according to claim 1, wherein the annular gap (R) has an inlet opening (E1) with a normal (N1), wherein the normal (N1) with a direction of flow (S) of the exhaust gas inlet nozzle includes an angle (a), with $90° < (a) < 180°$.

4. The exhaust gas muffler according to claim 1, wherein the second coupling pipe has an inlet opening (E2) with a normal (N2), wherein the normal (N2) with a direction of flow (S) of the exhaust gas inlet nozzle includes an angle (b), with $0° \Leftarrow (b) < 90°$.

5. The exhaust gas muffler according to claim 1, wherein in at least one housing portion a perforated resonator wall is provided within the second Helmholtz volume.

6. The exhaust gas muffler according to claim 1, wherein the first Helmholtz volume is delimited by housing walls and in at least one housing wall a leakage opening is provided, and/or the second Helmholtz volume is partly delimited by the at least one housing wall and the leakage opening is provided in the at least one housing wall.

7. The exhaust gas muffler according to claim 6, wherein the muffler housing has at least one further housing portion, in which at least the exhaust gas outlet and/or the exhaust gas inlet discharges and/or discharge, wherein the leakage openings joins both Helmholtz volumes together and/or at least one Helmholtz volume to the at least one housing portion.

8. The exhaust gas muffler according to claim 6, wherein the leakage opening of a housing wall has an overall cross-section (L) with $0 \Leftarrow (L) \Leftarrow 500\ mm^2$.

9. A system comprising an exhaust gas system for an internal combustion engine comprising the exhaust gas muffler according to claim 1.

10. The exhaust gas muffler according to claim 3, wherein with respect to angle a, $100° \Leftarrow (a) < 180°$.

11. The exhaust gas muffler according to claim 8, wherein with respect to overall cross-section (L), $0 \Leftarrow (L) \Leftarrow 200\ mm^2$.

12. The exhaust gas muffler according to claim 8, wherein with respect to overall cross-section (L), $0 \Leftarrow (L) \Leftarrow 100\ mm^2$.

13. The exhaust gas muffler according to claim 8, wherein with respect to overall cross-section (L), $0 \Leftarrow (L) \Leftarrow 50\ mm^2$.

14. The exhaust gas muffler according to claim 2, wherein the annular gap (R) has an inlet opening (E1) with a normal (N1), wherein the normal (N1) with a direction of flow (S) of the exhaust gas inlet nozzle includes an angle (a), with $100° \Leftarrow (a) < 180°$.

15. The exhaust gas muffler according to claim 14, wherein the second coupling pipe has an inlet opening (E2) with a normal (N2), wherein the normal (N2) with a direction of flow (S) of the exhaust gas inlet nozzle includes an angle (b), with $0° \Leftarrow (b) < 90°$.

16. The exhaust gas muffler according to claim 15, wherein in at least one housing portion a perforated resonator wall is provided within the second Helmholtz volume.

17. The exhaust gas muffler according to claim 16, wherein the first Helmholtz volume is delimited by housing walls and in at least one housing wall a leakage opening is provided, and/or the second Helmholtz volume is partly delimited by the housing wall and the leakage opening is provided in the housing wall.

18. The exhaust gas muffler according to claim 17, wherein the muffler housing has at least one further housing portion, in which at least the exhaust gas outlet and/or the exhaust gas inlet discharges and/or discharge, wherein the leakage openings joins both Helmholtz volumes together and/or at least one Helmholtz volume to the at least one housing portion.

19. The exhaust gas muffler according to claim 18, wherein the leakage opening of a housing wall has an overall cross-section (L) with $0 \Leftarrow (L) \Leftarrow 500\ mm^2$.

20. A system comprising an exhaust gas system for an internal combustion engine comprising the exhaust gas muffler according to claim 19.

* * * * *